United States Patent [19]

Hamm

[11] 4,315,626

[45] Feb. 16, 1982

[54] DEVICE FOR PRACTICING PUTTING STROKES

[76] Inventor: Purvis E. Hamm, P.O. Box 265, APO Miami, Fla. 34004

[21] Appl. No.: 175,897

[22] Filed: Aug. 6, 1980

[51] Int. Cl.[3] ..... A63B 69/36

[52] U.S. Cl. ..... 273/186 C; 273/192

[58] Field of Search ..... 273/192, 191, 186 C, 273/186 R

[56] References Cited

U.S. PATENT DOCUMENTS 3,510,136 5/1970 Ruspoli ..... 273/192 X 3,953,035 4/1976 Beckish ..... 273/192

*Primary Examiner*—George J. Marlo

*Attorney, Agent, or Firm*—Gunn, Lee & Jackson

[57] ABSTRACT

A convertible, compactible, transportable golf training device whereby a golfer may practice properly addressing and striking a golf ball to increase the accuracy of the golfer's putting. The device may be attached to a chair for indoor practice or easily converted for outdoor practice by insertion of spikes. For indoors, a pair of parallel spaced apart bars having screwably mounted perpendicular thereto a pair of spaced apart rods is secured to the legs of a chair. The rods projecting outward from the bars have holes in their forward ends that when aligned receive a trainer. The trainer, when inserted in the rods, is parallel to the bars and perpendicular to the rods. A golfer addresses a golf ball placed on the surface below the trainer and maintaining his putter in a squared position relative to the golf ball swings and strikes the golf ball.

For use on a putting green, the invention golf training device is converted by removing the bars discussed above and inserting a threaded spike in a hole in a rearward portion of each rod. The training device is rigid enough after inserting the spikes in the ground of a practice putting green a sufficient distance to maintain the trainer approximately parallel to the ground and allow the golfer to practice putting without hinderance.

2 Claims, 4 Drawing Figures

DEVICE FOR PRACTICING PUTTING STROKES

BACKGROUND OF THE INVENTION

In order to be successful in the game of golf, several skills are necessary. One must be able to drive a golf ball several hundred yards down a fairway and onto a putting green. Once upon the putting green, a golfer must be able to skillfully maneuver the golf ball into a cup in a minimum number of strokes. Often times it is on the putting green that the winner of a golf tournament is determined. Many golfers have won or lost tournaments in this somewhat limited area of a putting green by merely one stroke.

The invention golf training device enables one to practice his or her putting either in the confines of the home or on the practice putting green. The convertible, compactible, transportable invention device is easily adapted from home use to use on the practice putting green by a minimal amount of effort. Whether in the home or on the practice putting green, the invention golf training device allows a golfer to perfect his putting skills by providing a trainer as a point of reference relative to a golf ball. The trainer allows a golfer to squarely address a golf ball and freely strike the golf ball unencumbered and unrestricted. Practice with the invention golf training device permits a golfer to develop a correct and accurate putting style that when utilized in tournament play enables the golfer to accurately and consistently putt.

BRIEF DESCRIPTION OF THE PRIOR ART

Devices to help a golfer improve his putting skills are numerous. One such device is shown in U.S. Pat. No. 1,545,648 to Fletcher. In Fletcher's device, two parallel bars are spaced apart to allow the shaft and head of a putter to be inserted. These bars act as both a rearward and forward guide for the putter during the putting stroke. To hold Fletcher's putting device in position, the golfer places his feet on straps or braces that are fastened to the feet of the frame having the parallel bars attached thereto.

The golf putter guide of U.S. Pat. No. 3,269,733 to Taddy, et al., provides a means whereby direct contact between the shaft of the putter and the golf putting guide maintains the putter during its swinging movement in an accurate path. The device of Taddy, et al., is rigid and is to be utilized outdoors where it is anchored into a putting green by means of a plurality of prongs secured to a base.

Yet another golf putting training device is shown in U.S. Pat. No. 3,343,842 to Woerner wherein again as in the Fletcher patent device the golfer holds the training device in position by placing his foot in a U-shape bracket, the bracket attached to a guide member by means of a support. In utilizing the device of Woerner, a golfer places his putter slightly behind a ball that is positioned below the leading edge of the guide member with the shaft of the putter in contact with the edge of the guide member and the head of the putter at a right angle to the direction of desired movement of the putter head. At all times during the forward and backward swings of the putter, the shaft of the putter rests against and is guided by the edge of the guide member so the club head is forced to swing in one plane with a true pendulum motion.

A different type of putting practice device is shown in U.S. Pat. No. 3,572,720 to Burg. In this device, a golfer places a golf ball on the floor of a channel having slide flanges provided with rows of flexible flaps. When the golfer swings the putter against the ball to propel it towards a target cup, he must take care to avoid contacting the putter with the flaps on either side of the channel. If the putter makes contact with any of the flaps, the golfer senses this immediately and knows that his stroke is faulty.

The putter guide of Fahy in U.S. Pat. No. 3,685,835 attaches directly to the shaft of a golfer's putter. A golfer standing on the foot stand of the device merely grasps the handle of the putter and swivels the putter to make contact with the golf ball.

Although all of the above discussed patents are directed to a golf training device specifically directed to putting, the invention golf training device differs substantially from those of the prior art. The invention device allows the golfer to maintain a stance comfortable to him, whatever that stance may be, and make direct squared contact between his putter and the golf ball by merely looking down from above onto the trainer of the invention device and then aligning the face of the head of his putter with the golf ball.

SUMMARY OF THE INVENTION

It is the object of the present invention to provide a golf training device wherein a golfer's putter is unemcumbered by mechanical means and is free to make direct contact with a golf ball. The convertible, compactible, transportable golf training device of this invention comprises a pair of spaced apart parallel rods having holes in one end that when aligned receive a trainer perpendicular to the rods. For use indoors, the spaced apart parallel rods are held in a rigid configuration by threadably engaging a pair of spaced apart parallel bars perpendicular to the pair of rods, the parallel spaced apart bars designed to easily attach to the legs of an object such as an ordinary chair. For outdoor use, the invention golf training device comprises threadably inserting spikes in the rearward portion of the parallel spaced apart rods and then inserting the spikes in the ground of a practice putting green. The invention device can be easily assembled and disassembled thereby facilitating storing and transporting.

DESCRIPTION OF THE PREFERRED EMBODIMENT

Figure 1:
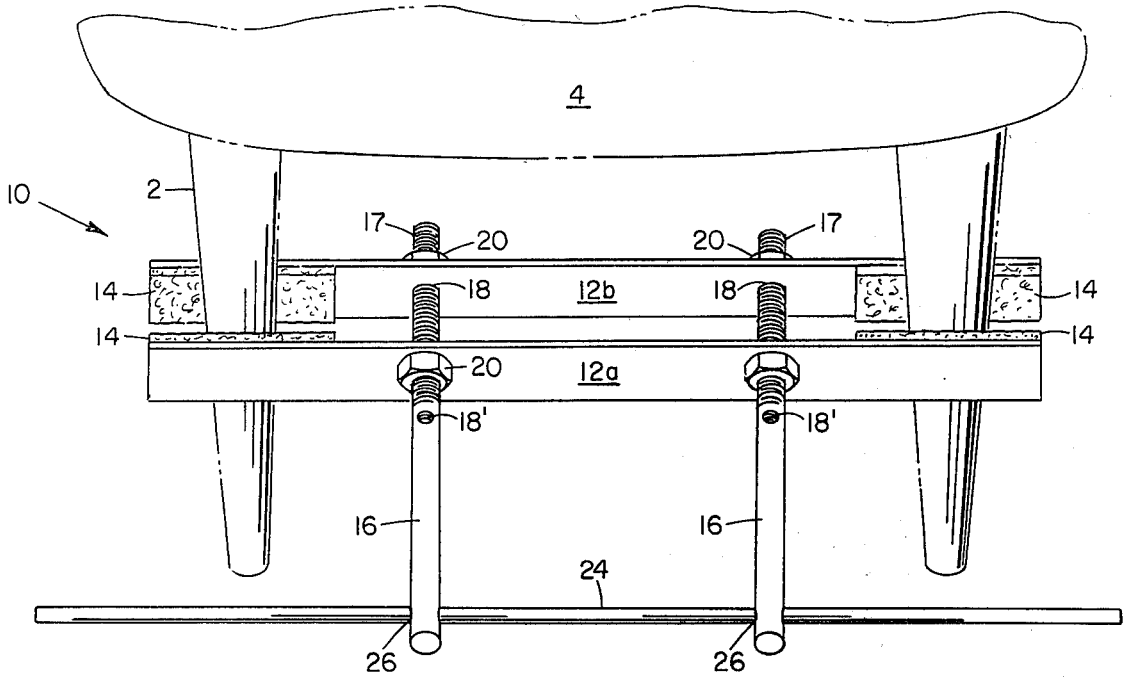
FIG. 1 is a perspective view of the invention golf training device attached to the legs of an ordinary chair.

In FIG. 1, the invention golf training device 10 is shown secured to the legs 2 of a chair 4. Parallel and spaced apart bars 12*a* and 12*b* having adhered to each end thereof pads 14 receive rods 16 in holes 18. In order to secure rods 16 in position, one end of rods 16 are threaded and inserted through holes 18 wherein nuts 20 subsequently tighten bars 12*a* and 12*b* into position. By screwing nuts 20 and securing rods 16 and bars 12*a* and 12*b* into a rigid configuration, the legs 2 of chair 4 are sandwiched and squeezed between pads 14 thus allowing the invention golf training device 10 to be secured in a stationary position.

On a forward end of rods 16 are holes 26. These holes 26 when properly aligned receive trainer 24. When in position in holes 26, trainer 24 is perpendicular to rods 16 and at the same time generally parallel to bars 12*a* and 12*b*. The invention device is secured to the legs 2 of chair 4 a sufficient distance above the floor to allow a golf ball 30 to be easily positioned below trainer 24 and to freely roll when struck by the golfer's putter.

The invention device may be constructed from any suitable material that is lightweight and easily portable. The preferred materials for the bars 12*a* and 12*b*, rods 16, and trainer 24 are aluminum or plastic. Pads 14 attached to bars 12*a* and 12*b* by conventional known means may be any material that will protect the legs 2 of a chair 4 and prevent the legs from becoming scarred, marred, or scratched as a result of the invention device being secured thereto. Preferred material that may be used as pads 14 are rubber, carpet, cloth, or resilient foam material.

Figure 2:
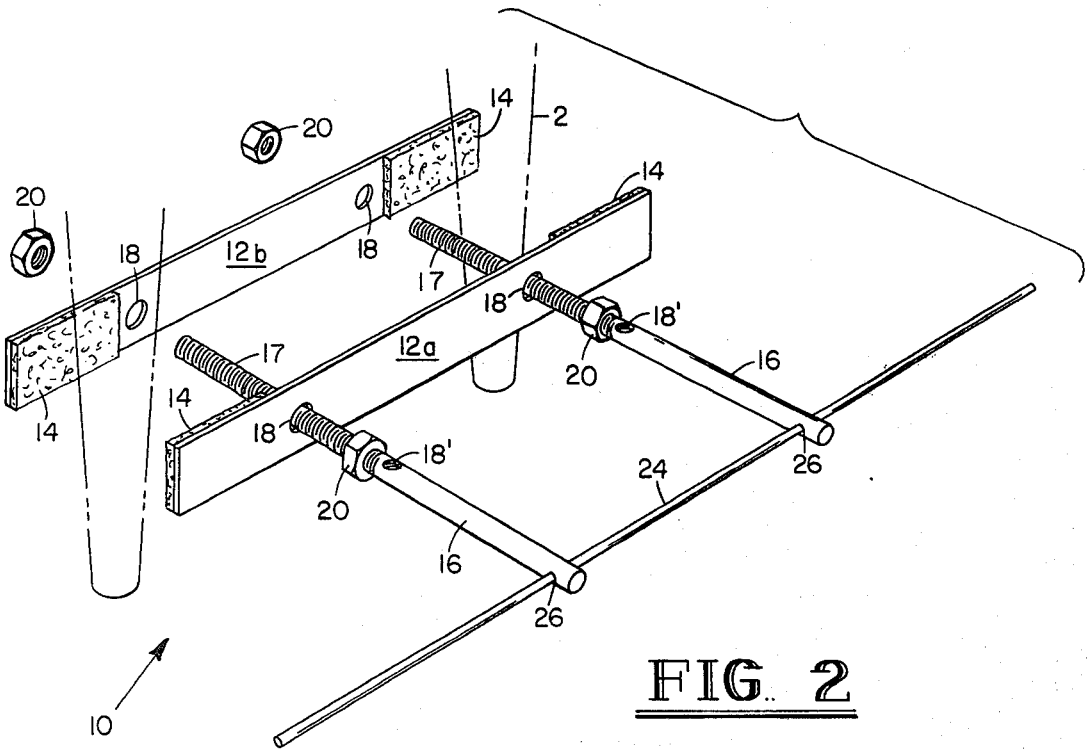
FIG. 2 is an exploded view of the device as depicted in FIG. 1.

A more detailed view of the invention golf training device is shown in the exploded view of FIG. 2. It is easily seen from this FIG. 2 how the invention golf training device 10 is fitted onto the legs of any ordinary chair. Bars 12*a* and 12*b* are positioned on either side of a pair of chair legs. Rods 16 are inserted through holes 18 of bar 12*a* and projected through the opening separating bars 12*a* and 12*b* whereupon they are inserted through holes 18 of bar 12*b*. Nuts 20*b* are subsequently threaded onto rods 16 to hold the rods in position until final securement of the device 10 to the chair legs 2. Upon inserting rods 16 through holes 18 in bars 12*a* and 12*b*, nuts 20*a* are rotated on the threads of rods 16 in order to bring bar 12*a* towards bar 12*b* and thereby squeeze the legs of a chair positioned in between these bars. Prior to final securement of the invention golf training device 10 onto the legs of a chair, unthreaded holes 26 on the forward end of rods 16 are aligned to receive trainer 24. When in position, trainer 24 is approximately parallel to bars 12*a* and 12*b* and horizontal to the floor. After trainer 24 has been inserted, nuts 20*a* and/or 20*b* are rotated to draw bars 12*a* and 12*b* close together and allow pads 14 to snugly and securely engage the legs of the chair. The invention golf training device 10 is now in position to be utilized indoors.

Figure 3:
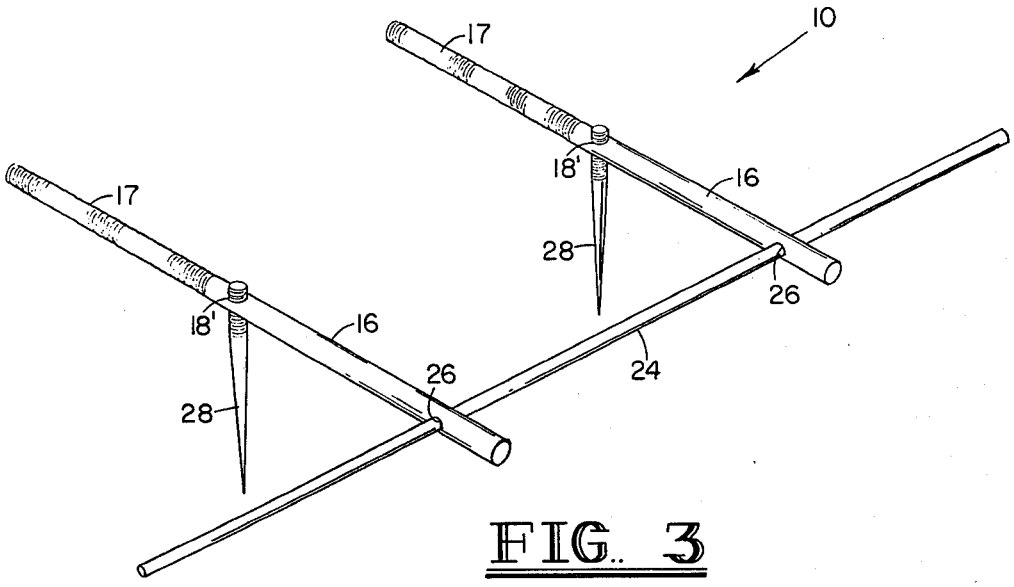
FIG. 3 is a perspective view of the invention device adapted for outdoor use.

The invention golf training device can be easily adapted for outdoor use as illustrated in FIG. 3. To convert from indoor to outdoor use, the bars 12*a* and 12*b* and nuts 20*a* and 20*b* as shown and discussed in reference to FIG. 2 are removed from rods 16. Spikes 28 having one end threaded are inserted into threaded holes 18' located in rods 16 in close proximity to threads 17 on the rearward portion of rods 16. The holes 18' that receive spikes 28 are at a 90° angle to the unthreaded holes 26 that receive trainer 24. With spikes 28 threaded into holes 18' and trainer 24 received through unthreaded holes 26, the invention golf training device 10 is now ready to be utilized outdoors on a practice putting green. The spikes 28 are pushed down into the practice putting green ground a sufficient depth in order to maintain the invention golf training device in a rigid configuration and position trainer 24 approximately horizontal to the practice putting green ground. Trainer 24 must, however, be a sufficient distance from the putting green surface to allow a golf ball placed directly below trainer 24 to roll freely when contacted by the head of a golfer's putter.

Figure 4:
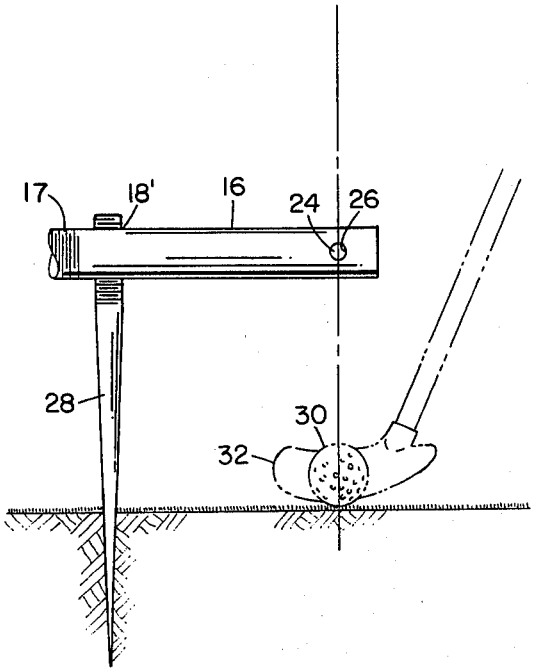
FIG. 4 is a side view of the invention device being utilized on a practice putting green.

FIG. 4 pictorially illustrates the invention device being utilized on a practice putting green. Spike 28 inserted in the putting green maintains rod 16 approximately parallel to the putting green. With rod 16 so positioned, trainer 24 is horizontal to the putting green and perpendicular to rod 16. A putter 32 is free to move below trainer 24 unencumbered by any attachments. Golf ball 30 is aligned beneath trainer 24 as discussed previously. When the golfer grasping putter 32 views downward onto trainer 24, half of the golf ball 30 appears on one side of trainer 24 while the other half appears on the other side of the trainer. With the golf ball in this position, the golfer is then ready to practice putting.

For the invention device to be effectively utilized, a golfer must follow certain guidelines. The golfer's body must be maintained parallel to trainer 24 at all times and kept perfectly still. It is most important that the golfer's upper body remain still and that the only movement be in the pendulum-like swing of the arms. If the upper body of the golfer moves during the putting stroke, the golf ball will not be squarely contacted by the face of the putter. If, however, the golfer keeps his body relaxed but in a firm position parallel to the trainer and only moves his arms to stroke the putter and thereby contact the ball, the putter will follow the trainer during the stroke and the putter will squarely strike the golf ball, resulting in a perfect putt.

It is to be noted that the invention device whether used indoors or outdoors can be utilized by both right- or left-handed golfers without adaptation of any kind.

As stated previously, the preferred materials for bars 12*a* and 12*b*, rods 16, trainer 24, and spikes 28 are aluminum or plastic. However, any lightweight yet sturdy material may be utilized. The preferred dimensions of the invention golf training device are as follows:

Bars 12*a* and 12*b*—approximately 21½" total length and 1¾" wide.

Holes 18—approximately ⅝" diameter centered in the width of the bars 12*a* and 12*b* and approximately 4" from the outer edge of bars 12*a* and 12*b*. With the holes in position as described, from the outer edge of one hole to the outer edge of another hole is approximately 13½".

Pads 14—approximately 4" in length running from the outer edge of bars 12*a* and 12*b* to the outer diameter of hole 18 and extending the full 1¾" width of bars 12*a* and 12*b*.

Rods 16—approximately 8⅜" long and having a diameter that when threaded on one end will be received in the ⅝" diameter holes 18 of bar 12*a* and 12*b*. Of the total 8⅜" length, the final 3" are threaded. Adjacent the threaded portion of rod 18, is ¼" threaded hole 18' that receives the threaded end of spike 28. At the forward end of rod 16 is unthreaded hole 26 of sufficient diameter to accommodate a trainer 24 having a diameter of ¼".

Trainer 24—approximately 21½" long and ¼" in diameter.

Spike 28—approximately 8⅜" in length, upper portion being threaded to a length of ⅜" and of a diameter to be accommodated by ¼" threaded hole 18' in rods 16. The upper unthreaded diameter of spike is ½" and tapers down to a point that is to be received in the ground.

METHOD OF OPERATION

Whether attached to the legs of an ordinary chair or inserted in a practice putting green, the invention device is utilized in the exact same manner. A golfer places his golf ball on the surface below the trainer 24 such that when viewed from above, half the golf ball will appear to be on either side of the trainer. The golfer, maintaining his body parallel to trainer 24 and perfectly still, addresses the golf ball then, moving only his arms in a pendulum-like swing, strokes to hit the golf ball squarely with the face of the putter. At all times during the procedure, the golfer makes sure only his arms move in order to have his putter squarely contact the golf ball. If the golfer's body is parallel to trainer 24 and his movement is limited to only his arms, the golfer's putter will maintain alignment with the trainer 24 both in the back swing and the follow through and will squarely contact the golf ball. The trainer 24 thus aids the golfer in maintaining this proper form such that after sufficient practice the golfer is capable of hitting the golf ball properly without the aid of the trainer of the invention device.

Although applicant has explained his golf training device in great detail as to the specific dimensions of each of his component parts, applicant should not be restricted to these limitations. While the invention has been described in connection with the preferred embodiment, it is not intended to limit the invention to the particular forms set forth, but on the contrary, it is intended to cover such alternatives, modifications, and equivalents as may be included within the spirit and scope of the invention as defined by the appended claims.

I claim:

1. A convertible, compactable, transportable, golf training device for practicing putting comprising:

(a) a first rod and a second rod, each of said rods being $8\frac{3}{8}''$ long, each of said rods being threaded at a first end of each said rod to be received within $\frac{5}{8}''$ diameter holes, each said rod having an unthreaded hole at a second end of each said rod sufficient to accomodate a trainer having a diameter of $\frac{1}{4}''$, and said first rod and said second rod being spaced apart $13\frac{1}{2}''$ from the outer edge of said first rod to the outer edge of said second rod in a parallel relationship, (b) a trainer $21\frac{1}{2}''$ long and $\frac{1}{4}''$ in diameter and being positioned through both said unthreaded hole of said first rod and said unthreaded hole of said second rod, (c) a first bar and a second bar, each said bar being $21\frac{1}{2}''$ long and $1\frac{3}{4}''$ wide, said first bar having a first bar hole and a second bar hole, each said bar hole being of $\frac{5}{8}''$ diameter centered within the width of said first bar, said first bar hole being located 4" from a first longitudinal end of said first bar and said second bar hole in said first bar located 4" from a second longitudinal end of said first bar, and said second bar having a third bar hole and a fourth bar hole each of $\frac{3}{8}''$ diameter, said third bar hole being centered in the width of said second bar and located 4" from a first longitudinal end of said second bar and said fourth bar hole centered in the width of said second bar and located 4" from a second longitudinal end of said second bar, said first rod being positioned through said first and third bar holes and said second rod being positioned through said second and fourth said bar holes, (d) at least four pads comprising a first pad, a second pad, a third pad, and a fourth pad, each said pad being 4" in length and comprised of a resilient material, said first pad being located at said first longitudinal end of said first bar, said second pad being located at said second longitudinal end of said first bar, said third pad being located at said first longitudinal end of said second bar, and said fourth pad being located at said second longitudinal end of said second bar, (e) said combination being adapted for secure attachment to a chair having legs, said legs being positioned inside between said first bar and said second bar, and (f) nuts comprising a first nut, a second nut, a third nut, and a fourth nut, said nuts being threadable upon a threaded $\frac{5}{8}''$ diameter rod, said first nut being threaded upon said threaded end of said first rod and being located outside of said first bar, said second nut being threaded upon said threaded end of said first rod and being located outside of said second bar, said third nut being located upon said threaded end of said second rod and being located outside of said first bar, and said fourth nut being threaded upon said threaded end of said second rod and located outside of said second bar, said nuts being adapted to securely attach said golf training device to said chair.

2. The device of claim 1 wherein each of said rods includes a threaded hole, and spikes adapted to be threaded into said threaded holes for maintaining said device in a sturdy position when inserted in the ground.

* * * * *